US007549376B1

(12) United States Patent
Grossman et al.

(10) Patent No.: US 7,549,376 B1
(45) Date of Patent: Jun. 23, 2009

(54) NON-LETHAL PROJECTILE CARRIER

(75) Inventors: Nicholas Liggett Grossman, Hackettstown, NJ (US); Jeffrey Darbig, Randolf, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/456,627

(22) Filed: Jul. 11, 2006

Related U.S. Application Data

(60) Provisional application No. 60/595,564, filed on Jul. 15, 2005.

(51) Int. Cl.
*F42B 10/00* (2006.01)
*F42B 8/00* (2006.01)

(52) U.S. Cl. ..... 102/473; 102/400; 102/439; 102/444; 102/446; 102/520; 102/522; 102/502

(58) Field of Classification Search ..... 102/473, 102/400, 517, 520, 521, 522, 439, 444, 446, 102/501, 502, 529, 482, 498
See application file for complete search history.

(56) References Cited

U.S. PATENT DOCUMENTS 32,689 A * 7/1861 Gault ..... 102/400
4,911,080 A * 3/1990 Leeker et al. ..... 102/529
5,214,238 A * 5/1993 Young ..... 102/520
5,235,915 A * 8/1993 Stevens ..... 102/439
5,361,700 A * 11/1994 Carbone ..... 102/439
5,361,701 A * 11/1994 Stevens ..... 102/450
5,392,714 A * 2/1995 Bilgeri ..... 102/522
6,543,364 B2 * 4/2003 Wes et al. ..... 102/490
6,779,463 B2 * 8/2004 Mutascio et al. ..... 102/502
6,799,519 B2 * 10/2004 Meyer et al. ..... 102/522
6,814,006 B2 * 11/2004 Johansson ..... 102/522
6,889,612 B1 * 5/2005 Liaw et al. ..... 102/477
6,997,110 B2 * 2/2006 Rastegar ..... 102/502
7,278,357 B2 * 10/2007 Keith et al. ..... 102/502
2002/0178960 A1 * 12/2002 Ramaswamy ..... 102/439
2003/0167958 A1 * 9/2003 Johansson ..... 102/522
2005/0188881 A1 * 9/2005 Diller ..... 102/458
2006/0278114 A1 * 12/2006 Millard ..... 102/439

* cited by examiner

*Primary Examiner*—James S Bergin
*Assistant Examiner*—Daniel J Troy
(74) *Attorney, Agent, or Firm*—Michael C. Sachs

(57) ABSTRACT

A non-lethal projectile carrier includes a base having a plurality of hinges, each hinge including a tab; and a payload case attached to the base, the payload case comprising a plurality of petaloid members, each petaloid member including an opening in a rear surface for insertion of a corresponding tab; wherein upon exiting a gun tube the petaloid members open and fold toward the base. Each petaloid member includes a lip on one edge and an undercut on another edge so that adjacent petaloid members form lap joints. The hinges are defined by zones of small cross-sectional area in the base.

1 Claim, 4 Drawing Sheets

NON-LETHAL PROJECTILE CARRIER

CROSS-REFERENCE TO RELATED APPLICATIONS

This application claims the benefit under 35 USC 119(e) of U.S. provisional patent application 60/595,564 filed on Jul. 15, 2005, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to non-lethal munitions.

Hostile or rioting crowds are not easily cleared by single shot non-lethal rounds. Current 40 mm non-lethal rounds such as the M1029 crowd control and the M1006 "sponge grenade" are single shot rounds. People that have been shot may have time to recover or protect themselves between shots. Continuous fire coverage with non-lethal projectiles can move or deter crowds from an area, allow or prevent access to an area or prevent the crowd from returning hostile action.

The present 40 mm non-lethal rapid fire round is complicated, expensive, unreliable and functions the weapon poorly. The present round is fired from a grenade machine gun and uses a telescoping rear case to power the gun. Conventional lethal ammunition does not function in this manner. The way the present round powers the weapon has created many problems. Thus, a need exists for a non-lethal round that utilizes a standard lethal case and that operates the weapon in the same manner as lethal ammunition.

SUMMARY OF THE INVENTION

It is an object of the invention to provide a non-lethal round that uses a standard lethal cartridge case.

It is another object of the invention to provide a non-lethal round that will open upon exit from the gun tube and release its payload.

It is a further object of the invention to provide a carrier for a non-lethal round that will rapidly decelerate upon exiting the gun tube.

One aspect of the invention is a projectile carrier comprising a base having a plurality of hinges, each hinge including a tab; and a payload case attached to the base, the payload case comprising a plurality of petaloid members, each petaloid member including an opening in a rear surface for insertion of a corresponding tab; wherein upon exiting a gun tube the petaloid members open and fold toward the base.

In one embodiment, the number of hinges, tabs and petaloid members is four. Preferably, each petaloid member includes a lip on one edge and an undercut on another edge so that adjacent petaloid members form lap joints. The hinges may be defined by zones of small cross-sectional area in the base. The base may include a backstop for each petaloid member for limiting folding of the petaloid member to about ninety degrees from a closed position.

Another aspect of the invention is a round comprising a cartridge case; and a projectile carrier attached to the cartridge case, the projectile carrier comprising a base having a plurality of hinges, each hinge including a tab; and a payload case attached to the base, the payload case comprising a plurality of petaloid members, each petaloid member including an opening in a rear surface for insertion of a corresponding tab; wherein upon exiting a gun tube the petaloid members open and fold toward the base.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
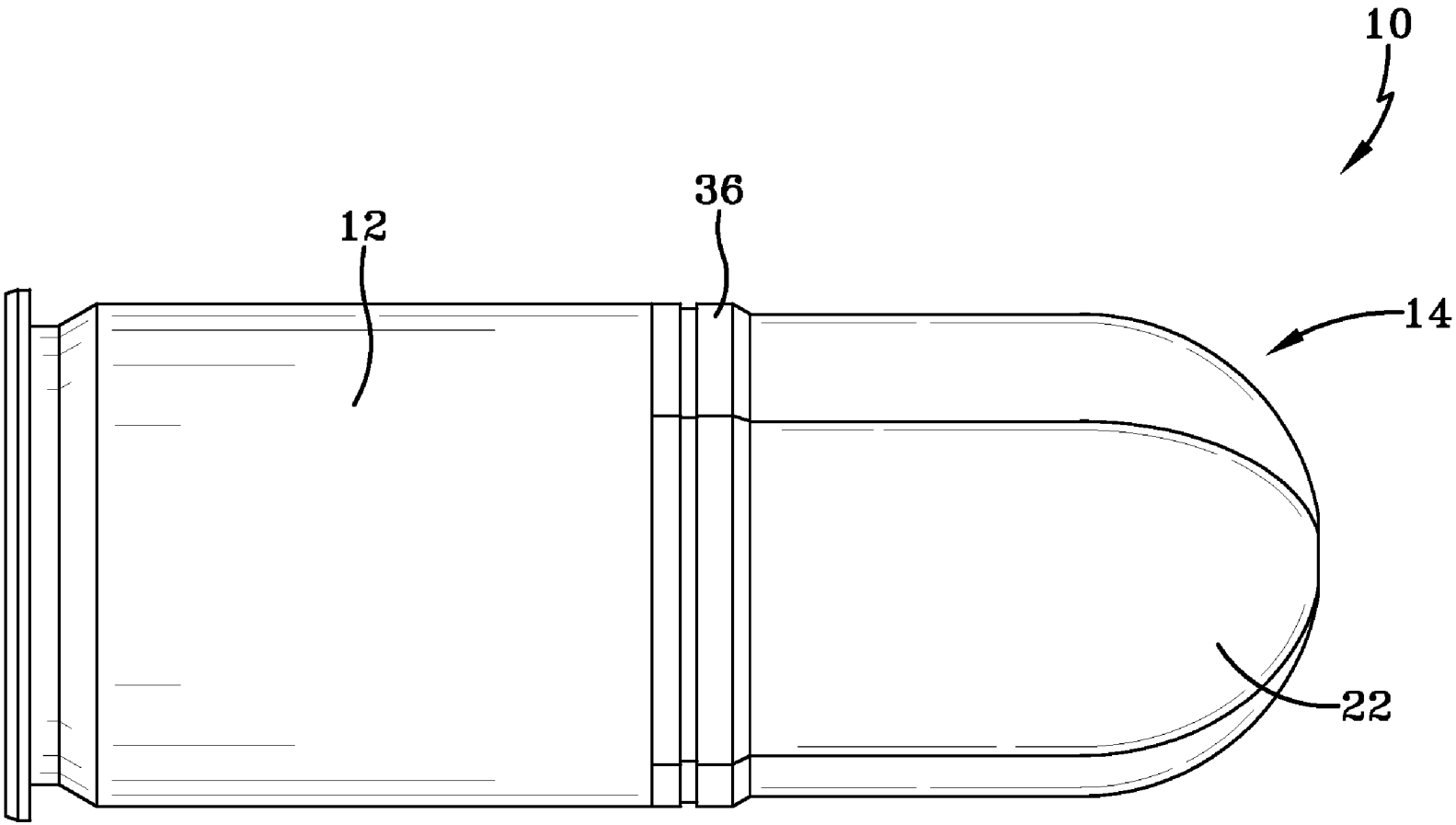
FIG. 1 is a side view of one embodiment of the inventive round.

One embodiment of the invention is a short range non-lethal round. The round may be used in a variety of weapons and calibers. One preferred embodiment is a 40 mm round for use in the Mk 19 grenade machine gun or Mk 47. The round is designed to be fired at a reduced velocity. The velocity may be reduced or increased by changing the mass of the round. Rifling in the gun barrel imparts spin to the round. The payload may be any non-lethal payload, for example, rubber balls or bean bags. The round may also carry a lethal payload, if desired. Examples of lethal payloads are buck shot and flechettes.

Referring now to the Figs., round 10 includes a cartridge case 12 and a projectile carrier 14. The cartridge case 12 may be a conventional cartridge case. The carrier 14 includes a base 16 and a payload case 22. Base 16 includes a plurality of hinges 18. Each hinge includes a tab 20. The payload case comprises a plurality of petaloid members 24 that define a payload cavity therein. Each petaloid member 24 includes an opening 26 in a rear surface thereof for insertion of a corresponding tab 20. In a preferred embodiment, the number of hinges 18, tabs 20 and petaloid members 24 is four.

Figure 2:
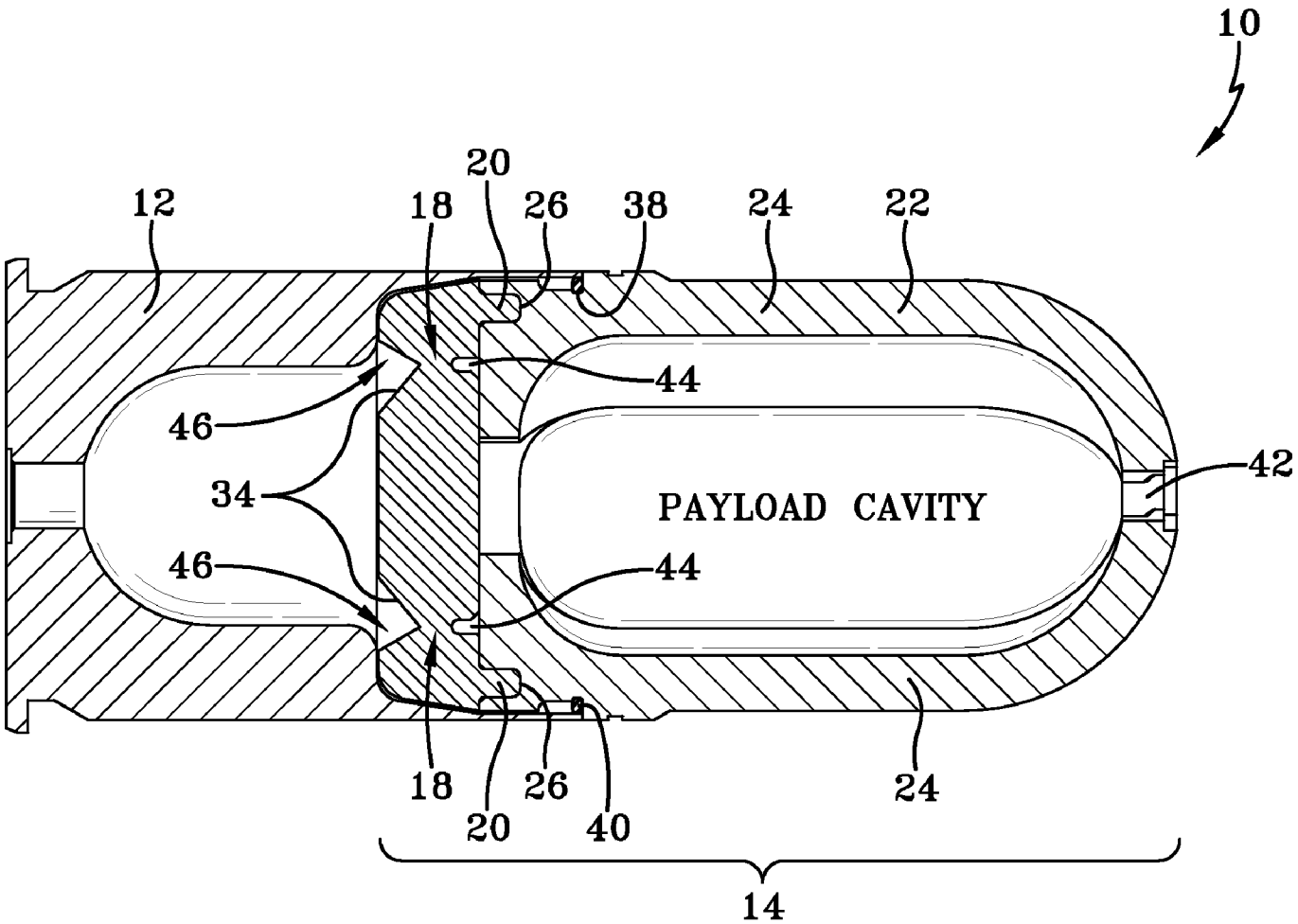
FIG. 2 is a cutaway view of FIG. 1.
Figure 3:
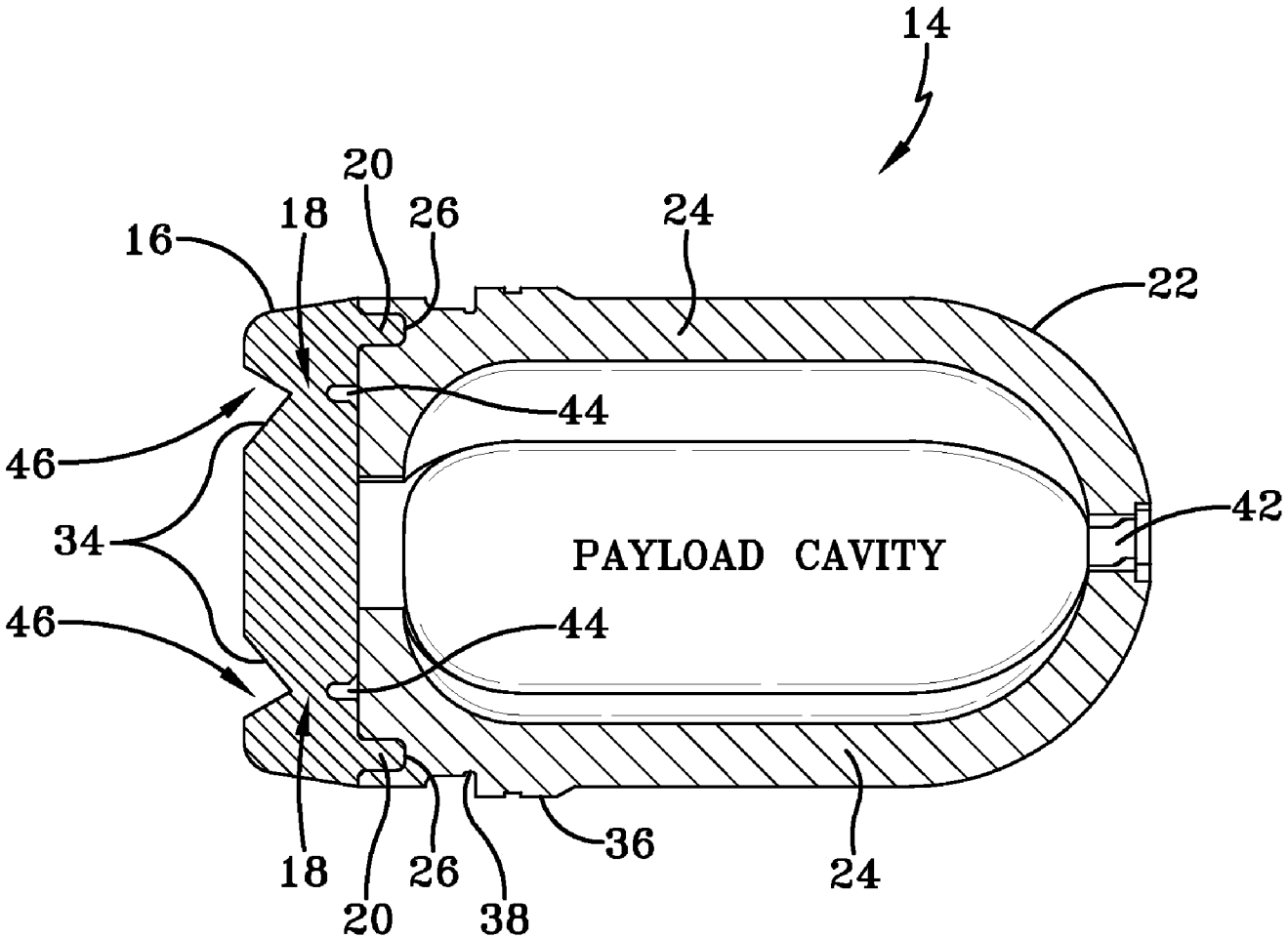
FIG. 3 shows the carrier of FIG. 2.
Figure 4:
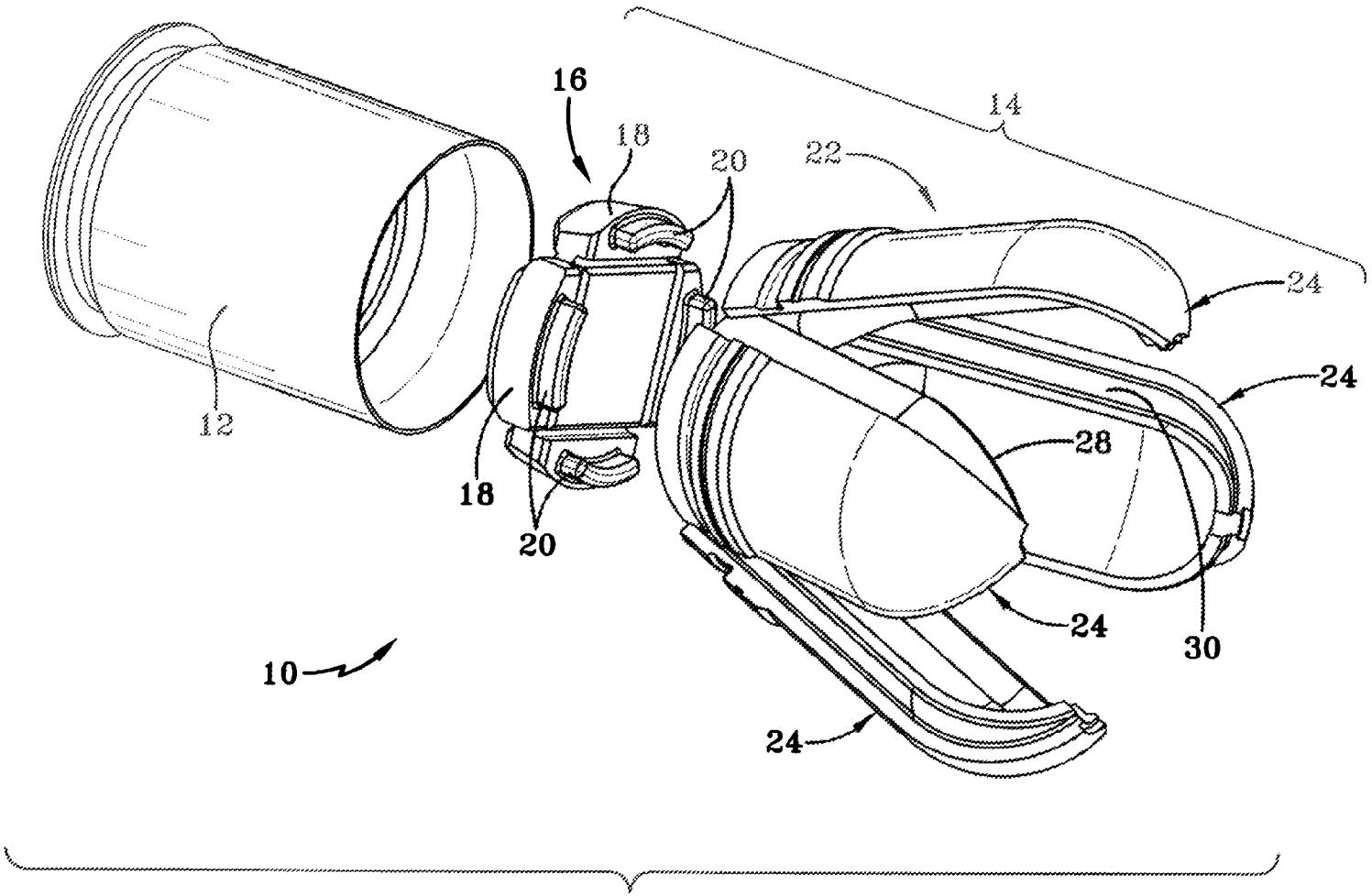
FIG. 4 is an exploded, perspective view of FIG. 1.

As best seen in FIG. 4, each petaloid member 24 includes a lip 28 on one edge and an undercut 30 on another edge. The lip 28 of one petaloid member fits over the undercut 30 of an adjacent petaloid member to form a lap joint. If needed, an adhesive may be applied to the lap joints. As seen in FIGS. 2 and 3, the tips of the petaloid members 24 form a small hole 42 at the nose of the carrier. The hole 42 is a natural result of manufacturing processes and may be plugged with a rubber disc or plug.

Hinges 18 are defined by zones of small cross-sectional area in the base 16. These zones may be created by forming grooves 44 in the front surface of the base 16 and corresponding grooves 46 in the rear surface of the base 16. The grooves 46 in the rear surface include a backstop 34. The backstop 34 is formed so that rotation of the petaloid member 24 is limited to about ninety degrees from the closed position.

The external surfaces of the petaloid members 24 define a driving band 36 that engages rifling in the gun tube and imparts spin to the round 10. A seal groove 38 is also formed in the external surfaces of the petaloid members 24. Seal groove 38 receives a seal 40 that seals the cartridge case 12 to the carrier 14. The payload case 22 may carry a lethal or non-lethal payload.

Base 16 preferably comprises a ductile metal or a ductile metal alloy. The material of the base must allow the hinges 18 to deform with breaking. Otherwise, the petaloid members 24 may break off and become unwanted lethal projectiles. Petaloid members 24 may comprise any material heavy enough to allow the members 24 to open and to adjust the weight of the round 10 for proper weapon function. Preferred materials are selected for ease of manufacture and include, for example, moldable materials such as plastics, ductile metals, and plastics infused with metal powder.

Because of the spin imparted to the round 10, the petaloid members 24 will begin to separate after exiting the gun tube, without using energetic material. As the petaloid members 24 separate, the payload inside is released. The air resistance causes the petaloid members 24 to continue to unfold until they resemble a fan. At this point, each hinge 18 will abut against a backstop 34 to prevent further unfolding of the petaloid members 24. The fan-like shape of the members 24 creates a large amount of drag and quickly slows the carrier 14 to a non-lethal velocity.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A round, comprising:

a cartridge case; and a projectile carrier attached to the cartridge case, the projectile carrier comprising a base having a plurality of hinges, each hinge including a tab; and a payload case attached to the base, the payload case comprising a plurality of petaloid members that define a payload cavity therein, each petaloid member including an opening in a rear surface for insertion of the corresponding said tab and wherein external surfaces of the petaloid members define a seal groove; wherein upon exiting a gun tube the petaloid members open and fold toward the base, without using energetic material; further comprising a seal disposed in the seal groove wherein the cartridge case fits in sealing engagement over the seal and seal groove.

* * * * *